US005935280A

United States Patent [19]

Lee

[11] Patent Number: 5,935,280

[45] Date of Patent: Aug. 10, 1999

[54] APPARATUS FOR FIXING TRASH BAG FOR VACUUM CLEANER

[75] Inventor: No-Soo Lee, Incheon, Rep. of Korea

[73] Assignee: Daewoo Electronics Co., Ltd., Seoul, Rep. of Korea

[21] Appl. No.: 08/989,399

[22] Filed: Dec. 12, 1997

[30] Foreign Application Priority Data

Mar. 31, 1997 [KR] Rep. of Korea ..... P 97-11565

[51] Int. Cl.[6] ..... B01D 46/02

[52] U.S. Cl. ..... 55/378; 55/506; 55/DIG. 2; 55/DIG. 3; 55/507; 15/347

[58] Field of Search ..... 55/374, 378, 377, 55/506, 507, DIG. 2, DIG. 3, 381, 481, 509; 15/347

[56] References Cited

U.S. PATENT DOCUMENTS

| | | | |
|---|---|---|---|
| 4,591,369 | 5/1986 | Stewart . | |
| 4,678,486 | 7/1987 | Jacob . | |
| 4,738,697 | 4/1988 | Westergren . | |
| 5,089,038 | 2/1992 | Kopco . | |
| 5,472,465 | 12/1995 | Schmierer . | |
| 5,544,385 | 8/1996 | Jailor et al. . | |
| 5,755,009 | 5/1998 | Stephens et al. | 15/347 |

FOREIGN PATENT DOCUMENTS

| | | | |
|---|---|---|---|
| 3403135 | 8/1985 | Germany | 55/DIG. 2 |

*Primary Examiner*—Jay H. Woo
*Assistant Examiner*—Robert Hopkins
*Attorney, Agent, or Firm*—Pillsbury Madison & Sutro LLP

[57] ABSTRACT

An apparatus for fixing a trash bag to a vacuum cleaner that prevents the trash bag from being freely moved right and left and improves an assembling productivity of the fixing apparatus is disclosed. The fixing apparatus has first and second guiding bars formed on an inner wall of the dust collecting chamber for guiding a cardboard when the cardboard of the trash bag is inserted therein. First and second supporting brackets prevent the cardboard of the trash bag from being freely moved right and left by fixing the cardboard guided by the first and the second guiding bar. A fixing member which is elastically fixed inside of the first and second brackets prevents the cardboard of the trash bag, which is fixed by the first and the second supporting brackets, from being freely moved right and left. A fixing boss integrally formed with a floor of the dust collecting chamber and protruded upward fixes the fixing member to the first and second supporting brackets. During an operation of the vacuum cleaner, the trash bag is not allowed to freely move right and left and the assembling productivity of the trash bag fixing device can be improved.

13 Claims, 6 Drawing Sheets

APPARATUS FOR FIXING TRASH BAG FOR VACUUM CLEANER

BACKGROUND OF THE INVENTION

1. Field of the Invention

The present invention relates to a vacuum cleaner, and mode particularly to an apparatus for fixing a trash bag to a vacuum cleaner.

2. Description of the Prior Art

A vacuum cleaner is an apparatus for sucking external dust or materials by a powerful sucking force generated by a driving force of a motor which is mounted therein. The sucked dusts or sweepings are captured by a trash bag set in a dust collecting chamber, and clean air is exhausted out through a driving chamber.

Generally, a vacuum cleaner is classified as a canister type vacuum cleaner and an upright type vacuum cleaner. The canister type vacuum cleaner has a main body built on wheels and a hose assembly to suck dust or materials into the main body. The main body includes a sucking force generating section such as a sucking fan, a motor for driving the sucking force generating section and a dust collecting chamber for filtering out the dust or the materials from the sucked air.

The upright type vacuum cleaner has a constitution similar to the canister type vacuum cleaner. But, in the upright type vacuum cleaner, the hose assembly is unnecessary because a target surface to be cleaned is positioned under a main body of the vacuum cleaner. Recently, the canister type vacuum cleaner has been more widely used than the upright type vacuum cleaner.

In FIG. 1, a conventional canister type vacuum cleaner 100 is illustrated. As shown in the FIG. 1, the vacuum cleaner 100 includes a main body 110 being movable by wheels 120 mounted thereunder at both sides; a dust collecting chamber 130, provided within the main body 110, for scavenging the sucked dusts or garbages; a trash bag 140 detachably set in the dust collecting chamber 130; a flexible hose 150 connected to an inlet of the dust collecting chamber 130; and a brush head assembly 160, coupled to one end of the flexible hose 150 and making contact with a floor, for sucking dust and garbage.

Generally, in case of cleaning work with the vacuum cleaner 100, dust and external stuff sucked by the brush assembly 160 are captured in the trash bag 140 provided in the dust collecting chamber 130 through the flexible hose 150, while a clean air is exhausted out through the trash bag 140.

Since the dust collecting chamber 130 is frequently opened and closed for the exchanging of the trash bag 140, a hood 170 that is capable of selectively being opened and closed is installed on top of the dust collecting chamber 130. The trash bag 140 has a collecting part 142 for capturing dust and garbage, and a cardboard 144, which is provided at a part of the collecting part 142, and has an inlet 146. In addition, between the collecting part 142 and the cardboard 144 is provided a flexible sealing member 149 (shown in FIG. 2) for preventing an air leakage at the time of coupling the trash bag 140 with the flexible hose 150. The trash bag 140 is coupled to a fixing member 180 which is formed in the dust collecting chamber 130, and the trash bag 140 may be attached to or detached from the fixing member 180 by the cardboard 144.

FIG. 2 shows a state where the trash bag 140 is installed in the dust collecting chamber 130. As shown FIG. 2, the fixing member 180 has a neck which is protruded upward from a floor of the dust collecting chamber 130, for fixing a lower part of the cardboard 144 of the trash bag 140; a fixing lever 184, formed on an inner upper portion of the dust collecting chamber 130, for fixing an upper portion of the cardboard 144; and a spring 186 for elastically supporting the fixing lever 184. A central portion of the fixing lever 184 is hingedly coupled to the wall of the dust collecting chamber 130 by a hinge pin 188. Accordingly, the lower portion of the fixing lever 184 always presses the cardboard 144 of the trash bag 140 by the spring 186.

If the trash bag 140 is inserted into the dust collecting chamber 130, the fixing lever 184 is rotated upward, and a space is provided where the cardboard 144 of the trash bag 140 is inserted into the locking projection 182. After the cardboard 144 is inserted through the space, the fixing lever 184 is rotated downward by the elastic force of the spring 186 and presses the upper portion of the cardboard 144 of the trash bag 140, and thereby fixing of the trash bag 140 is completed. Through the above procedure, the trash bag 140 is fixed in the dust collecting chamber 130.

In a case of withdrawing the trash bag 140, the trash bag 140 can be withdrawn from the dust collecting chamber 130 by reversely performing the above procedure. That is, the fixing lever 184 is rotated upward to provide a space through which the cardboard 144 of the trash bag 140 can be withdrawn from the neck 182. The cardboard 144 is withdrawn through the room, and the fixing lever 184 is rotated downward by the elastic force of the spring 186 to recover its original position. Through the above procedure, the trash bag 140 is withdrawn from the dust collecting chamber 130.

However, this type of fixing member may not avert a free movement of the cardboard of the trash bag due to a vibration generated from a driven vacuum cleaner. As a result, the cardboard may not be tightly coupled with the flexible hose and thereby, a suction operation becomes unstable. Besides, in a procedure of coupling the fixing member with the inner wall of the dust collecting chamber, the spring should be correctly positioned for assembling a hinge, and this makes an assembling work complex.

On the other hand, an embodiment that is similar to an apparatus for fixing a trash bag to the vacuum cleaner is disclosed in U.S. Pat. No. 5,544,385 (issued to John Jailor at Aug. 13, 1996, entitled "Filtering Bag Mounting Assembly For A Vacuum Cleaner").

According to John Jailor's teaching, a fixing plate coupled with a wall of a dust collecting chamber by a hinge is disclosed, wherein a fixing groove is formed at one end of the fixing plate. A cardboard of a trash bag is inserted into the fixing groove and thereby, the fixing plate is integrally coupled with the cardboard. Thereafter, the trash bag is connected to an inlet of a vacuum cleaner by rotating the fixing plate about a hinge.

However, using this type of fixing device has a problem that the cardboard may freely move left and right during operation of the vacuum cleaner because the cardboard is not inserted completely into the fixing plate.

SUMMARY OF THE INVENTION

Therefore, the present invention is invented to solve the above problems of the prior arts, and it is an object of the present invention to provide an apparatus for fixing a trash bag to a vacuum cleaner for preventing the trash bag from being freely moved right and left and for improving an assembling productivity of the fixing apparatus.

In order to accomplish the object of the present invention, there is provided an apparatus for fixing a trash bag having a cardboard into a dust collecting chamber of a vacuum cleaner, the apparatus comprising:

first and second guiding bars formed on an inner wall of the dust collecting chamber for guiding a cardboard when the cardboard of the trash bag is inserted therein;

first and second supporting brackets for preventing the cardboard of the trash bag from being freely moved right and left by fixing the cardboard guided by the first and the second guiding bars;

a fixing member elastically fixed inside the first and second brackets, for preventing the cardboard of the trash bag, which is fixed by the first and the second supporting brackets, from being freely moved right and left; and a fixing boss integrally formed with a floor of the dust collecting chamber and protruded upward, fixing the fixing member to the floor of the dust collecting chamber.

According to the present invention, the first and second guiding bars are formed at both sides of an inlet of the dust collecting chamber to face each other, and are vertically formed on the floor of the dust collecting chamber. Each of the first and second guiding bars has a locking groove at its lower portion for locking the fixing device.

The first and second brackets are formed at both sides of the inlet of the dust collecting chamber to face each other, and are formed in parallel with the first and second guiding bars outside the first and second guiding bars.

Each of the first and the second brackets includes a vertical supporting bracket which is formed to be perpendicular to an inner wall of the dust collecting chamber, and a horizontal supporting bracket which is formed to be perpendicular to the vertical supporting bracket, and which elastically fixes the fixing member to the inside of the first and second brackets.

The fixing boss has a cavity therein, wherein the inner surface of the cavity is provided with a screw thread and is coupled with a bolt.

The fixing member has a horizontal portion coupled with the fixing boss by the bolt, a vertical portion formed to be perpendicular to the horizontal portion, wherein the cardboard of the trash bag can be slidably inserted therein, an elastic portion which is located between the vertical portion and the horizontal portion and allows for an elastic movement of the vertical portion, and an elastic member attached to one side of the vertical portion for elastically supporting the vertical portion.

The horizontal portion of the fixing member is provided with a penetration hole through which a bolt which is engaged with the fixing boss passes at one end thereof, and is provided with a notch portion which is inserted into a locking groove of the second guiding bar at the middle thereof. At an upper portion of the vertical portion of the fixing member, a neck which is coupled to an upper portion of the second supporting bracket is additionally formed, thereby preventing a horizontal free movement of the vertical portion. Here, the neck is integrally formed with the vertical portion apart from the vertical portion and has a depth the same as that of the vertical supporting bracket of the second supporting bracket.

The elastic member is composed of a flexible component so that the vertical portion can be elastically moved with respect to the horizontal portion. A coil spring, where one end of the spring is coupled to one end of the vertical portion and the other end of the spring is elastically supported by an inner surface of the second supporting bracket, is provided as the elastic member.

As another embodiment of the elastic member, a plate spring is provided where one end of the plate spring is coupled to a portion of the vertical portion, and the other end of the plate spring is elastically supported by an inner surface of the second supporting bracket.

As the other embodiment of the elastic member, a torsion spring is provided where one end of the plate spring is coupled to one side of the vertical portion, and the other end of the plate spring is elastically supported by an inner surface of the second supporting bracket.

The trash bag fixing apparatus of a vacuum cleaner according to the present invention has such advantages that, during an operation of the vacuum cleaner, the trash bag is not allowed to freely move right and left and the assembling productivity of the trash bag fixing device can be improved.

BRIEF DESCRIPTION OF THE DRAWINGS

The above object and other advantages of the present invention will become more apparent by describing in detail preferred embodiments thereof with reference to the attached drawings, in which.

DETAILED DESCRIPTION OF THE INVENTION

Hereinafter, a preferred embodiment of the present invention will be explained in more detail with reference to the accompanying drawings.

Figure 1:
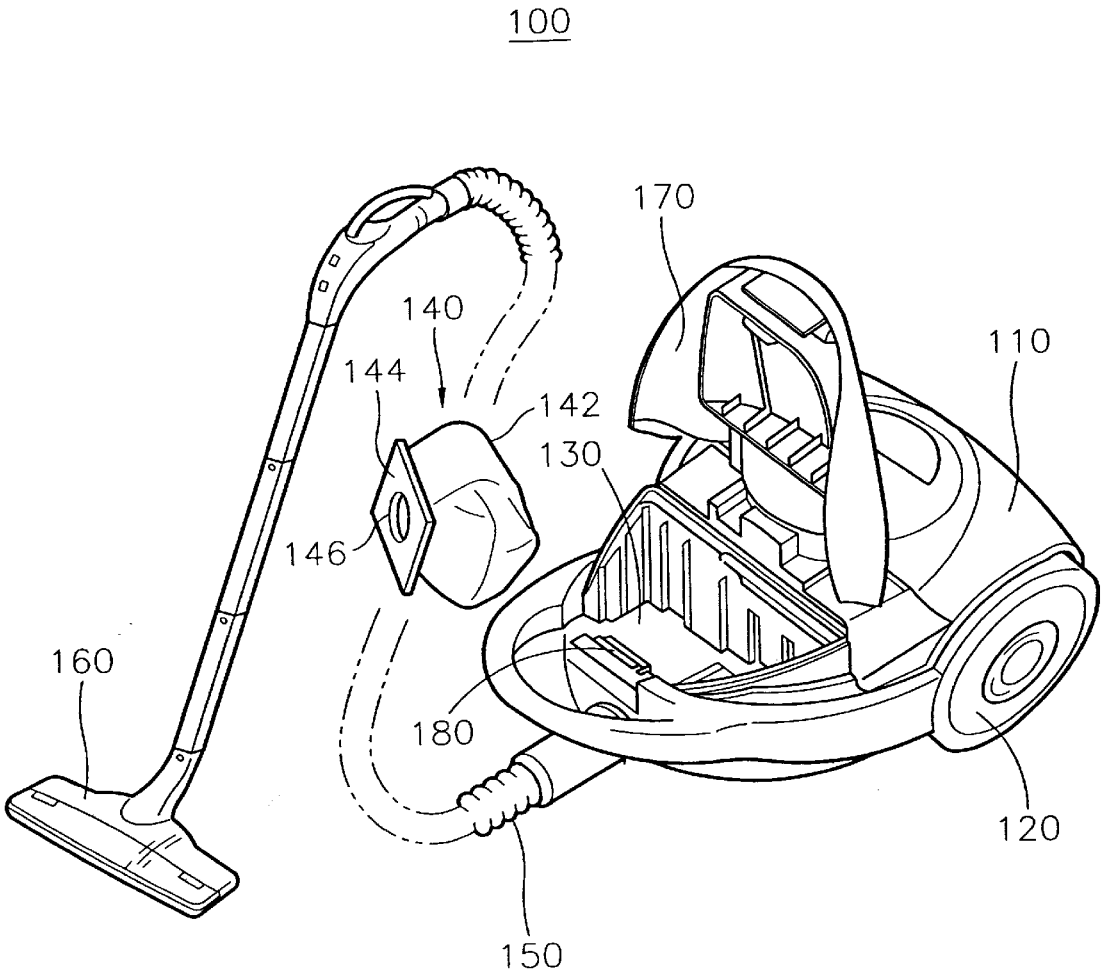
FIG. 1 (PRIOR ART)
FIG. 1 is a perspective view showing an inside of the dust collecting chamber of a conventional vacuum cleaner and a trash bag set inside the dust collecting chamber.
Figure 2:
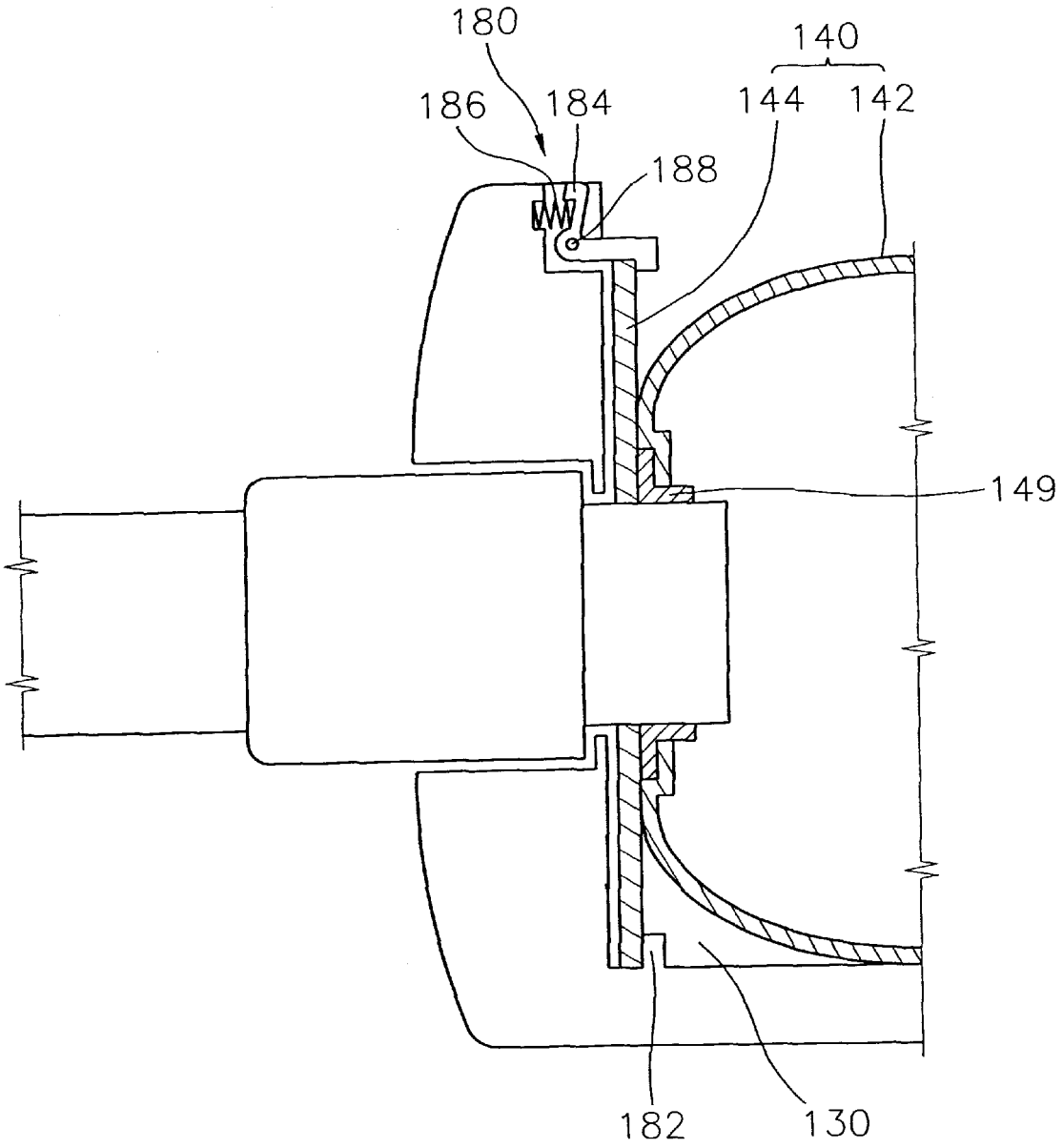
FIG. 2 (PRIOR ART)
FIG. 2 is a side sectional view showing a state where the trash bag shown in FIG. 1 is set inside the dust collecting chamber.
Figure 3:
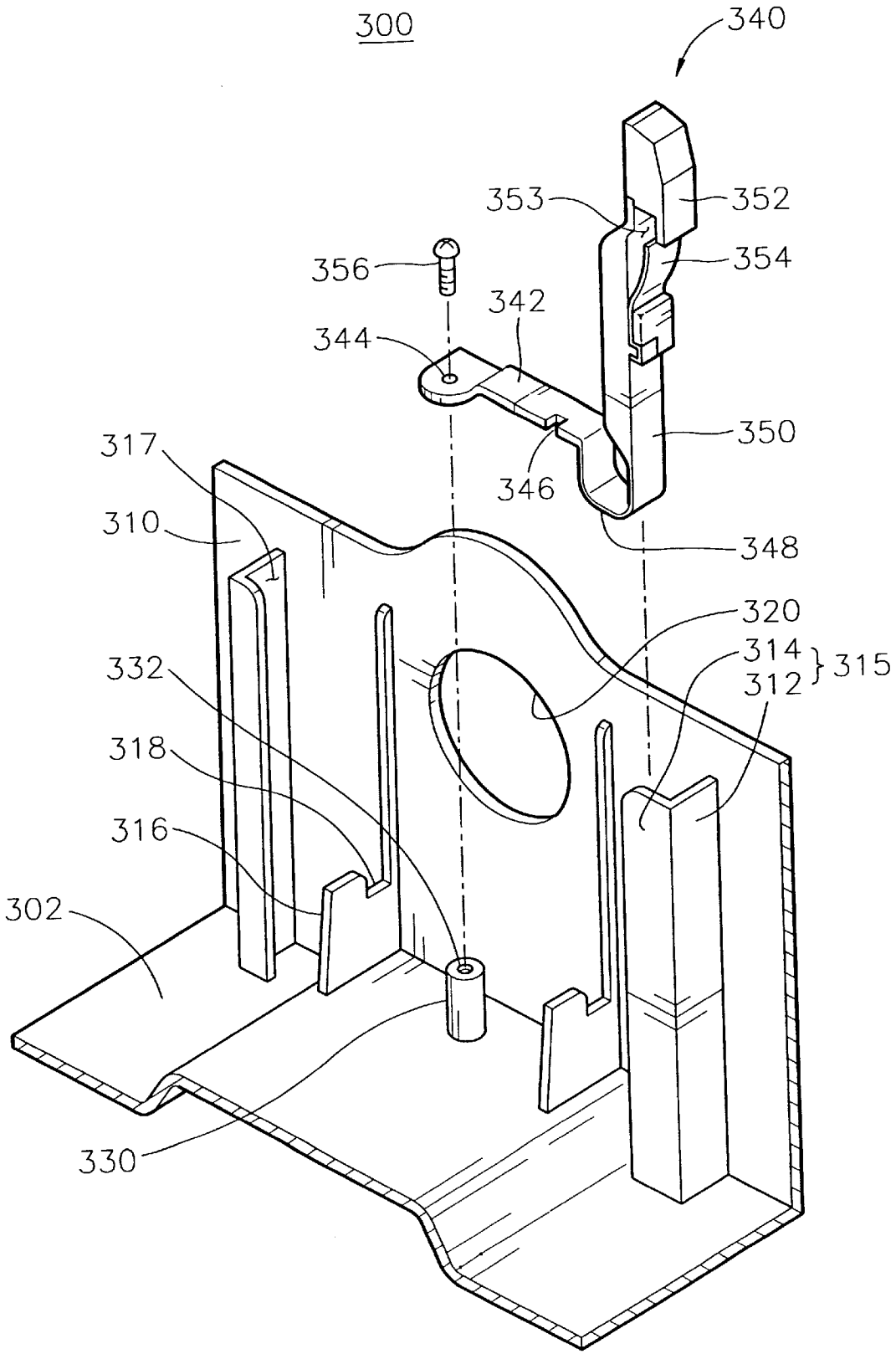
FIG. 3 is an exploded perspective view showing a fixing apparatus installed inside the dust collecting chamber in a vacuum cleaner according to one embodiment of the present invention.

In FIG. 3, a fixing apparatus 300 for a trash bag of a vacuum cleaner, according to one embodiment of the present invention, is illustrated. The trash bag fixing device 300 is an apparatus for fixing a trash bag 364 (shown in FIG. 4) into a dust collecting chamber 302 of a vacuum cleaner. The fixing apparatus 300 has first and second guiding bars 316 formed on an inner wall of the dust collecting chamber 302 for guiding a cardboard 360 (shown in FIG. 4) when the cardboard 360 of the trash bag 364 is inserted thereinto; first and second supporting brackets 315 for preventing the cardboard 360 of the trash bag 364 from being freely moved right and left by fastening the cardboard 360 guided by the first and second guiding bars 316; a fixing member 340 elastically fixed inside the first and second brackets 315, for preventing the cardboard 360 of the trash bag 364, which is fixed by the first and second supporting brackets 315, from being freely moved right and left; and a fixing boss 330 protruded upward from a floor of the dust collecting chamber 302, for fixing the fixing member 340 to the dust collecting chamber 302.

Here, the first and second guiding bars 316 face each other when taking an inlet 320 as a center, and are vertically protruded from a floor of the dust collecting chamber 302. Each of the first and second guiding bars 316 has a locking groove 318 at its end portion which supports a lower end portion of the cardboard 360 of the trash bag 364 to prevent the movement of the trash bag 364.

The first and second supporting brackets 315 are formed at outer locations of the first and second guiding bars 316 respectively, when being viewed from the inlet 320, to be parallel with the first and second guiding bars 316. In addition, each of the first and second supporting brackets 315 has a vertical supporting bracket 312 which is formed to be perpendicular to an inner wall of the dust collecting chamber 302, and a horizontal supporting bracket 314 which is perpendicularly extended from one end of the vertical supporting bracket 312. The fixing member 340 is slidably inserted into a groove 317, which is formed by the horizontal and vertical supporting brackets 312 and 314.

The fixing boss 330 is located between the first and second guiding bars 316. The fixing boss 330 is protruded upward from a floor of the dust collecting chamber 302. The fixing boss 330 has a cavity 332, and a screw thread is formed at a surface of the cavity 332 so that a bolt 356 is screwed thereto.

The fixing member 340, which is slidably inserted between the first and second supporting brackets 315, has a horizontal portion 342 that is coupled with the fixing boss 330 by the bolt 356; a vertical portion 350 that is formed to be perpendicular to the horizontal portion 342 and guides the cardboard 360 of the trash bag 364 when the cardboard 360 is slidably inserted; an elastic portion 348, which is arranged between the horizontal portion 342 and the vertical portion 350, for allowing the vertical portion 350 to elastically move; and an elastic piece 354, which is attached to one portion of the vertical portion 350, for elastically supporting the vertical portion 350.

At one end of the horizontal portion 342 of the fixing member 340, a penetration hole 344 is formed, through which passes the bolt 356 that is to be coupled with the fixing boss 330. At the middle portion of the horizontal portion 342, a notch portion 346, which is inserted into the locking groove 318 formed at a lower end portion of the second guiding bar 316, is formed. The fixing member 340 is installed at an inner wall 310 of the dust collecting chamber 302 by being coupled to the bolt 356 and the locking groove 346 so that the fixing apparatus 340 may be inserted thereinto and withdrawn therefrom.

At the top of the vertical portion 350 of the fixing member 340, a neck projection 352 is additionally formed. The necking projection 352 is coupled to the top of the second supporting bracket 315. The necking projection 352 is integrally formed with the vertical portion 350 and is separated from the vertical portion 350 by a distance the same as the width of the second supporting bracket 315. When the cardboard 360 of the trash bag 364 is inserted, the right side of the cardboard 360 is slidably inserted along an inner side of the second supporting bracket 315.

At this time, the second supporting bracket 315 is inserted into the gap between the neck projection 352 which is formed at the top of the vertical portion 350 of the fixing member 340 and the vertical portion 350. Here, a neck 352 is provided so as to prevent the vertical portion 342 from moving further toward the central of the inlet 320. Accordingly, the fixing member 340 presses the cardboard 360 of the trash bag 364 so as to prevent the right and left movement of the cardboard 360.

Further, the elastic portion is arranged between the vertical portion 350 and the horizontal portion 342 of the fixing member 340. When the cardboard 360 of the trash bag 364 is slidably inserted between the first and second supporting brackets, the vertical portion 350 of the fixing member 340 may be elastically moved toward the center of the inlet 320 due to the presence of the elastic portion 348. Accordingly, the elastic portion 348 is comprised of a flexible component which allows the elastic movement.

An elastic piece 354 is provided at one side of the vertical portion 350 of the fixing member 340 so as to elastically support the cardboard 360 of the trash bag 364. When the cardboard 360 of the trash bag 364 is slidably inserted along the first and second brackets 315, the vertical portion 350 elastically supports the cardboard 360 due to the presence of the elastic piece 354. One end of the elastic piece 354 is supported by the vertical portion 350 of the fixing member 340 and the other end of the elastic piece 354 elastically makes contact with the inner surface of the second supporting brackets 312. When the cardboard 360 of the trash bag 364 is inserted into the fixing member 340, the elastic piece 354 is pressed so that the vertical portion 350 of the fixing member 340 elastically supports the cardboard 360.

Figure 6:
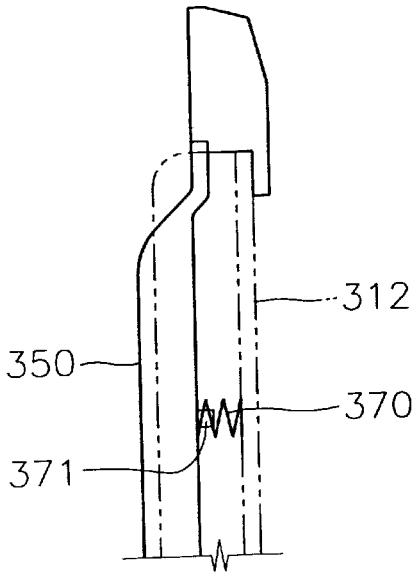
FIG. 6 is a side view showing a state where a compression coil spring is mounted, as one example of the elastic member according to the present invention.

FIG. 6 is a side view showing a state where a compression coil spring is mounted, as one example of the elastic member. As shown in the figure, a compression coil spring 370 as an elastic member is attached to a rear surface of the vertical portion 350 of the fixing member 340. One end of the compression coil spring 370 is supported by a projection 371 which is protruded from the rear surface of the vertical portion 350. The other end of the compression coil spring 370 is supported by the inner wall of the second supporting bracket. When the cardboard 360 of the trash bag 364 is inserted into the fixing member 340, the compression coil spring 370 is pressed so that the vertical portion 350 of the fixing member 340 elastically supports the cardboard 360.

Figure 7:
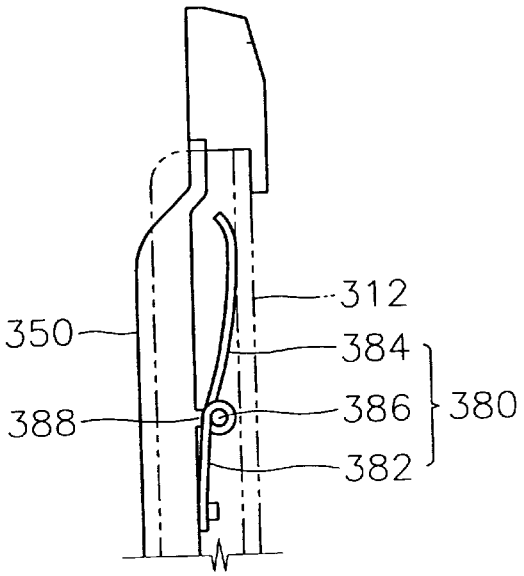
FIG. 7 is a side view showing a state where a torsion spring is mounted, as another example of the elastic member according to the present invention.

FIG. 7 is a side view showing a state where a torsion spring 380 is mounted, as another example of the elastic member, which is attached to a rear surface of the vertical portion 350 of the fixing member 340. As shown in the figure, the first leg portion 382 of the torsion spring 380 is supported by the vertical portion 350. The second leg portion 384 of the torsion spring 380 is supported by the inner wall of the second supporting bracket.

A circular ring 386 which is located between the first and second leg portions 382 and 384 is engaged with a projection 388 which is protruded from a rear surface of the vertical portion 350. In the same manner as in the use of the compression coil spring, when the cardboard 360 of the trash bag 364 is inserted into the fixing member 340, the torsion spring 380 is pressed so that the vertical portion 350 of the fixing member 340 elastically supports the cardboard 360.

Figure 4:
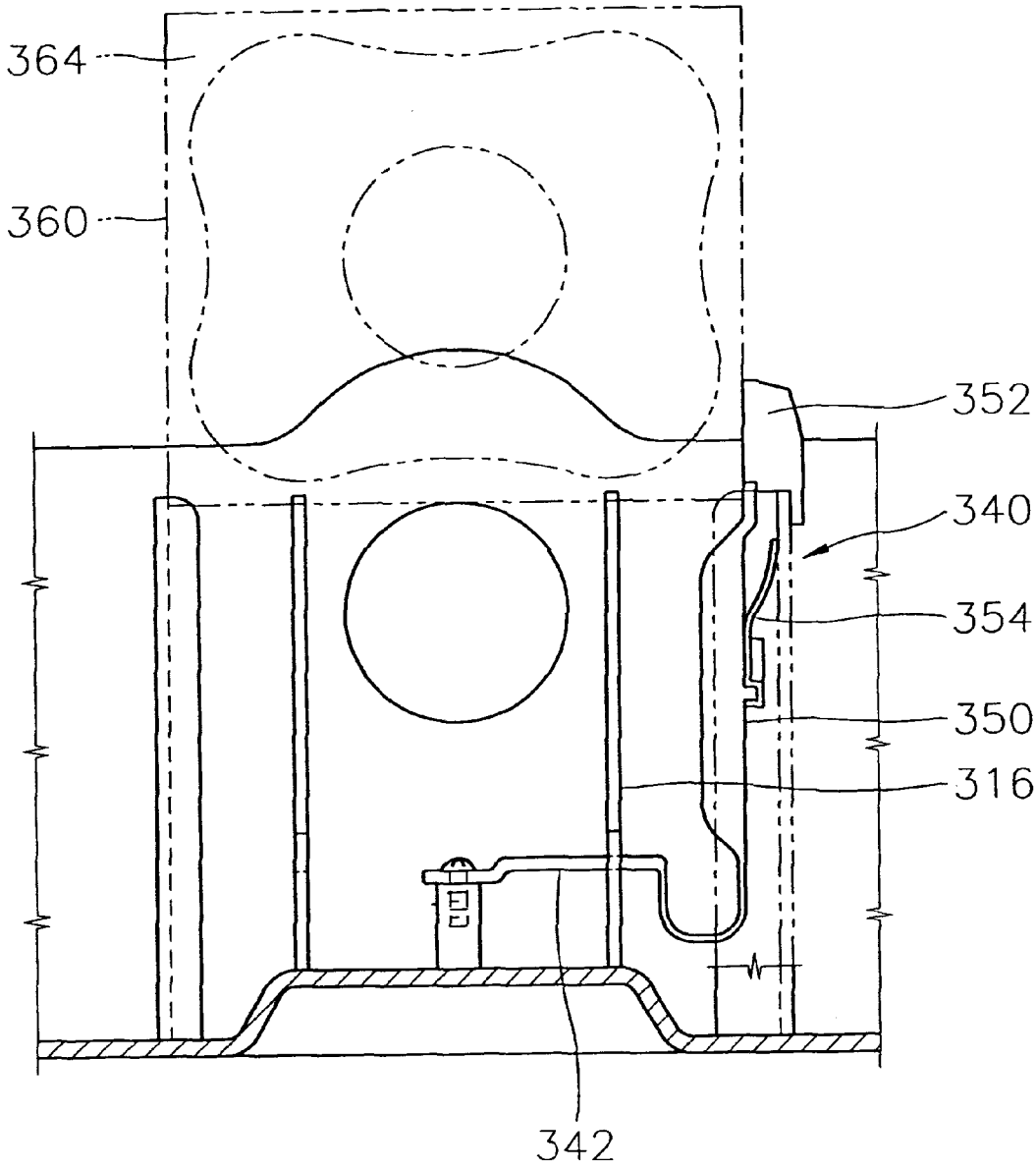
FIG. 4 is a view showing an operation state before the cardboard of the trash bag is inserted into the fixing apparatus according to the present invention.
Figure 5:
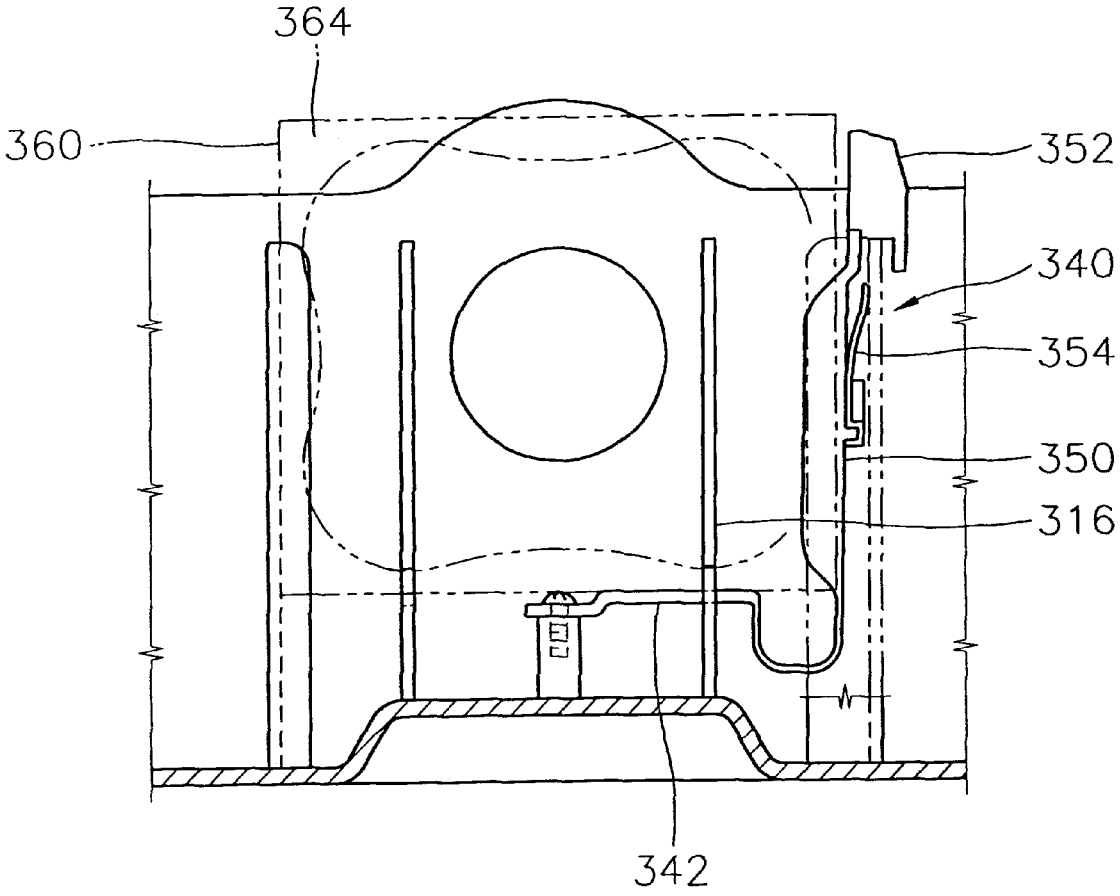
FIG. 5 is a view showing an operation state after the cardboard of the trash bag is inserted into the fixing device according to the present invention.

Hereinafter, referring to FIGS. 4 and 5, the procedure for inserting the cardboard of the trash bag into the fixing apparatus of the present invention will be explained.

As shown in the figures, when the trash bag 364 is inserted into the fixing member 340, both lower end portions of the cardboard 360 are positioned at an upper portion of the first and second supporting brackets 312 of the fixing member 340. When an external downward force is applied to the upper end portion of the cardboard 360, the cardboard 360 is moved downward by being guided by the first and second guiding bars 316.

At this time, the right side of the cardboard 360 is slidably inserted along the inner surface of the first and second supporting brackets 315. Here, the elastic piece 354 which is attached to the rear surface of the vertical portion 350 elastically supports the inner surface of the second supporting bracket 315 as the cardboard 360 moves downward.

Lastly, then the lower end portion of the cardboard 360 makes contact with the upper surface of the horizontal portion 342 of the fixing member 340, and when the neck 352 is attached to the upper portion of the vertical portion 350 of the fixing member 340, the engagement of the cardboard 360 is completed. The vertical portion 350 of the fixing member 340 continuously presses the cardboard 360 due to the elastic force of the elastic member 354.

When the trash bag 364 is drawn from the fixing member 340, the procedure which is the inverse of the inserting procedure is performed.

As explained above, the trash bag fixing apparatus of a vacuum cleaner according to the present invention has such advantages that, during an operation of the vacuum cleaner, the trash bag is not allowed to freely move right and left and the assembling productivity of the trash bag fixing device can be improved.

Although the preferred embodiment of the invention has been described, it is understood that the present invention should not be limited to this preferred embodiment, but various changes and modifications can be made by one skilled in the art within the spirit and scope of the invention as hereinafter claimed.

What is claimed is:

1. An apparatus for fixing a trash bag having a cardboard in a dust collecting chamber of a vacuum cleaner, said apparatus comprising:

first means for guiding a cardboard when the cardboard of the trash bag is inserted therein, said first means being formed on an inner wall of the dust collecting chamber;

second means for preventing the cardboard of the trash bag from being freely moved right and left by fixing the cardboard guided by said first means;

third means, elastically fixed to said second means, for preventing the cardboard of the trash bag, which is fixed by the the second means, from being freely moved right and left; and fourth means, integrally formed with a floor of the dust collecting chamber and protruded upward, for fixing said third means to the floor of the dust collecting chamber such that the third means is biased against the second means, wherein said third means has a horizontal portion coupled with said fourth means by a fixing means, a vertical portion formed to be perpendicular to the horizontal portion, into which the cardboard of the trash bag is slidably inserted, an elastic portion which is located between the vertical portion and the horizontal portion and allows the vertical portion to elastically move, and an elastic member attached to a portion of the vertical portion, for elastically supporting the vertical portion.

2. The apparatus as claimed in claim 1, wherein said first means includes first and second guiding bars, and the first and second guiding bars are formed at both sides of an inlet of the dust collecting chamber so that they face each other and are vertically formed on the floor of the dust collecting chamber.

3. The apparatus as claimed in claim 2, wherein each of the first and second guiding bars has a locking groove at its lower portion for locking said third means.

4. The apparatus as claimed in claim 1, wherein said second means includes first and second supporting brackets, the first and second brackets are formed at both sides of the inlet of the dust collecting chamber so that they face each other, and the first and second brackets are formed in parallel with said first means outside said first means.

5. The apparatus as claimed in claim 4, wherein each of the first and second brackets includes a vertical supporting bracket which is formed to be perpendicular to an inner wall of the dust collecting chamber and a horizontal supporting bracket which is formed to be perpendicular to the vertical supporting bracket so that the third means is elastically fixed to the inside of the first and second brackets.

6. The apparatus as claimed in claim 1, wherein the fourth means includes a fixing boss that has a cavity therein, a surface of the cavity being provided with a screw thread, and the screw thread being coupled with a fixing member.

7. The apparatus as claimed in claim 1, wherein the horizontal portion of said third means is provided with a penetration hole through which a fixing member coupled to said fourth means passes, and is provided with a notch portion which is inserted into a locking groove of the second guiding bar at a middle portion thereof.

8. The apparatus as claimed in claim 1, wherein at an upper portion of the vertical portion of said third means, a neck projection which is coupled to an upper portion of the second supporting bracket is formed so as to prevent a horizontal free movement of the vertical portion due to the elastic member.

9. The apparatus as claimed in claim 8, wherein the neck projection is integrally formed with the vertical portion apart from the vertical portion by a distance the same as a width of the vertical supporting bracket of the second supporting bracket.

10. The apparatus as claimed in claim 1, wherein the elastic portion is comprised of a flexible component so that the vertical portion is elastically moved with respect to the horizontal portion.

11. The apparatus as claimed in claim 1, wherein the elastic member is a coil spring whose first end is coupled to one side of the vertical portion and whose second end is elastically supported by an inner surface of the second supporting bracket.

12. The apparatus as claimed in claim 1, wherein the elastic member is a plate spring whose first end is coupled to one side of the vertical portion and whose second end is elastically supported by an inner surface of the second supporting bracket.

13. The apparatus as claimed in claim 1, wherein the elastic member is a torsion spring whose first end is coupled to one side of the vertical portion and whose second end is elastically supported by an inner surface of the second supporting bracket.

* * * * *